US005676818A

United States Patent [19]

Delapierre et al.

[11] Patent Number: 5,676,818

[45] Date of Patent: Oct. 14, 1997

[54] PROCESS FOR THE PRODUCTION OF A MICROTIP ELECTRON SOURCE

[75] Inventors: Gilles Delapierre, Seyssins; Robert Meyer, St Nazaire les Eymes, both of France

[73] Assignee: Commissariat a l'Energie Atomique, Paris, France

[21] Appl. No.: 512,827

[22] Filed: Aug. 9, 1995

[30] Foreign Application Priority Data

Aug. 16, 1994 [FR] France ..... 94 10041

[51] Int. Cl.[6] ..... C25F 3/00; C23F 1/02

[52] U.S. Cl. ..... 205/664; 205/666; 156/345

[58] Field of Search ..... 205/664, 666; 156/345

[56] References Cited

U.S. PATENT DOCUMENTS 5,026,437 6/1991 Neukermans et al. ..... 148/33.3

5,151,061 9/1992 Sandhu .

5,258,107 11/1993 Yoshida et al. ..... 205/664 X

FOREIGN PATENT DOCUMENTS 0 461 990 12/1991 European Pat. Off. .

WO89/09479 10/1989 WIPO .

*Primary Examiner*—Donald R. Valentine

*Attorney, Agent, or Firm*—Oblon, Spivak, McClelland, Maier & Neustadt, P.C.

[57] ABSTRACT

According to this process a structure is produced comprising an insulating substrate (10) carrying at least one cathode conductor (12), an insulating layer (14), a gate layer (16), holes being formed through these layers, level with the cathode conductor. In the holes are formed microtips made from a metallic material by forming a protective insulating layer (50) on the gate layer, forming a chemical deposit (60) of the metallic material at the bottom of the holes until said material overflows therefrom, by eliminating the protective layer and by electrolytically etching the metallic material. Application to the manufacture of flat screens.

9 Claims, 3 Drawing Sheets

PROCESS FOR THE PRODUCTION OF A MICROTIP ELECTRON SOURCE

DESCRIPTION

The present invention relates to a process for the production of a microtip electron source. It more particularly applies to the production of flat displays.

When a potential difference is applied between two electrodes, whereof one is pointed, the thus produced electrical field can easily reach, at the end of said pointed electrode, a value of approximately $10^7$ V/cm, which is adequate to ensure that electrons are extracted from said electrode.

Such a principle is used for producing cold electron sources able to replace electron emitting heating wires, due to the fact that said cold sources have a faster response, a lower electrical consumption and can undergo greater miniaturization than said heating wires.

One of the most important applications of said cold electron sources, also known as "microtip sources" is the manufacture of flat television tubes. Reference should be made to FIGS. 1 and 2 for the principle of said flat tubes or flat screens.

FIG. 1 is a partial, diagrammatic, sectional view of such a flat screen and FIG. 2 a partial, diagrammatic, perspective view of said flat screen.

The flat screen of FIGS. 1 and 2 comprises a microtip electron source 2 and a glass substrate 4, which is separated from the source 2 by a space having a limited thickness and in which a vacuum is formed.

Facing the source 2, the substrate 4 carries an electrically conductive, transparent layer 6, e.g. of indium and tin oxide and itself carries cathodoluminescent elements 8, also known as "phosphors".

On an electrically insulating substrate 10, e.g. of glass, the microtip source 2 has an array of parallel cathode conductors 12 constituting the columns of the screen. These cathode conductors are covered by a layer 14 of an electrically insulating material such as silica.

An array of other parallel electrical conductors 15 is placed above the insulating layer 14 and these other conductors 15 or gates are perpendicular to the cathode conductors 12 in order to form the screen rows.

At the intersections between the cathode conductors and the gates, holes 18, 19 are formed through the insulating layer 14 and said gates 15 and microtips 20 made from an electron emitting material are formed in these holes and rest on the cathode conductors 12.

The phosphors 8 are formed on the transparent conductive layer 6 facing said intersections and as can be seen in FIG. 2.

The electrons are extracted by applying appropriate voltages between the gates and the microtips and then said electrons are accelerated by means of appropriate voltages applied between the gates and the conductive layer 6 forming the anode of the screen. Each phosphor 8 excited by electrons 22 emits light 24.

An appropriate voltage scan on the rows and columns of the screen makes it possible to form an image.

Only the microtips located at the intersection of a row and a column supplied with voltage emit electrons in order to form an image element or pixel. Thus, each pixel is "excited" by several hundred microtips, whose dimensions are approximately 1 μm, generally 1.5 μm and which are spaced from one another by a distance of a few micrometers, typically 5 μm.

These small dimensions are indispensable so as on the one hand not to have to use excessive voltages between the gates and the microtips (voltage approximately 50 V) and on the other to have a sufficiently high current emission per surface unit (approximately 1 mA/mm$^2$).

Thus, a flat screen typically uses approximately 10,000 microtips per square millimetre on surfaces of several square decimetres.

The presently manufactured flat screens have surfaces of approximately 5 dm$^2$ and consideration is being given to the manufacture of flat screens with surfaces up to approximately 1 m$^2$.

However, it is not easy to obtain microtip sources having such large surfaces with the known microtip production processes.

The most widely used process for producing microtips is the Spindt process (after the name of the inventor). Reference can be made in this connection e.g. to the following document:

(1) C. A. Spindt, J. Appl. Phys., vol. 39, p.3504, 1968.

FIG. 3, which diagrammatically illustrates this process, shows a structure comprising an insulating substrate 10 on which are formed the cathode conductors 12 and the insulating layer 14, which is formed on said cathode conductors and which carries an electrically conductive gate layer 16. The actual gates are obtained from said gate layer 16 after forming the microtips, as will be shown hereinafter.

After having chemically etched the holes 18 and 19 respectively in the insulating layer 14 and in the gate layer 16, a nickel layer **16*a* is deposited on the gate layer 16** by vapour deposition under grazing incidence.

The microtips 20 are obtained by evaporating an electron emitting material 26. A layer 28 of said material then forms on the surface of the gate layer **16*a*. Therefore the holes 19 formed in these layers 16,16*a* decrease progressively as the thickness of the layer 28** increases.

As the deposition or vaporization is very directional, the diameter of the material deposits 26 in the holes 18 of the insulating layer 14 varies like the diameter of the holes of the layer **16*a* and the gate layer 16, which leads to a pointed shape of the deposits in the holes 18, i.e. the microtips 20. The layer 28 is then eliminated by the selective dissolving of the nickel layer 16*a***, so that the microtips appear.

The main advantage of this known process is that it requires no precise alignment of the microlithography masks, because the holes of the gate layer themselves define the microtips.

Thus, it would be virtually impossible to firstly etch the microtips and then the holes of the gate layer by conventional microlithography methods with an alignment precision exceeding 1 micrometer in the case of large surfaces.

Another known process for the production of microtips is described in the following document:

(2) Oxidation-Sharpened Gated Field Emitter Array Process, N. E. McGruer et al., IEEE Transactions on Electron Devices, (38) 1991 October, No. 10.

Said other process is diagrammatically illustrated in FIG. 4, which shows a silicon substrate 30. The first stage consists of the surface oxidation of said substrate and then disks 32 are formed from the silica layer resulting from said oxidation.

A reactive ionic etching of the silicon substrate 30 then makes it possible to form silicon pedestals 34, the disks 32 serving as masks. This is followed by the formation of a silica layer 36 on the substrate 30 by evaporating the silica 38. On each disk 32 is then formed a silica layer 40.

The pedestals 34 are then thermally oxidized, which leads to the formation of microtips 42 from said pedestals.

This is followed by the formation of a gate layer 44 by the deposition of an electrically conductive material on the silica layer 36. During said deposition, a layer 46 of said material also forms on the silica layer 40 associated with each disk 32.

The silica covering the microtips 42, as well as the disks 32 and the corresponding layers 40 and 46 is then eliminated.

The disadvantage of the known processes described hereinbefore is that they require highly directional depositions or vaporizations.

Returning e.g. to FIG. 3, the angle of incidence θ of a deposition beam F varies as a function of the position of the holes 19 of the gate layer 16, which leads to the phenomenon illustrated in FIG. 5, i.e. to microtips, whose axes Y become less perpendicular to the surface of the substrate 10 as the angle of incidence θ increases.

This leads to a variation in the shape of the microtips, which induces a dispersion of the electron emission characteristics and in the limiting case brings about a short-circuit between the microtips and the gate layer.

In order to solve this problem, consideration could be given to increasing the distance L between the deposition source 48 containing the material 26 and the surface of the structure on which said material 26 is deposited, in order to maintain the angle θ within acceptable limits. However, this leads to an excessive increase in the size of the microtip production equipment and to an excessive decrease in the deposition rate.

The object of the present invention is to obviate these disadvantages.

The invention therefore relates to a process for the production of a microtip electron source, wherein:

production takes place of a structure comprising an electrically insulating substrate, at least one cathode conductor on said substrate, an electrically insulating layer covering each cathode conductor, an electrically conductive gate layer covering said electrically insulating layer, holes being formed through said gate layer and the electrically insulating layer, at each cathode conductor and in each hole is formed a microtip, which is made from an electron emitting metallic material and which rests on the cathode conductor corresponding to said hole, said process being characterized in that the formation of the microtips involves the following stages:

an electrically insulating protective layer is formed on the gate layer, a chemical deposit, preferably of an electrolytic nature of the electron emitting metallic material is formed at the bottom of the holes until the said metallic material overflows the same, the protective layer is eliminated and electrolytic etching takes place of the deposited metallic material, so as to obtain microtips from said metallic material.

According to a special embodiment of the process according to the invention, preferred as a result of its performance simplicity, the gate layer is used as the cathode for electrolytically etching the metallic material.

During said dissolving phase, it is advantageous to regenerate by any known means the electrolyte located around the metallic material so as to avoid an overconcentration of metal ions, which could slow down the dissolving and bring about a significant redeposition of said material on the gate around the microtips being formed.

A limited redeposition or a controlled redeposition spreading over the entire gate is acceptable and leads to a significant reduction in the diameter of the holes, which is favourable to the emission of electrons by the microtips.

The protective layer can be formed by depositing, under grazing incidence, a layer of an electrically insulating material on the gate layer. However, said protective layer is preferably formed by anodic oxidation of the gate layer.

The gate layer can be made from a material chosen from within the group including niobium, tantalum and aluminium.

The metallic material can be chosen from within the group including iron, nickel, chromium, Fe—Ni, gold, silver and copper.

The protective layer can be eliminated by chemical etching. This protective layer can also be eliminated by reactive ionic etching.

BRIEF DESCRIPTION OF DRAWINGS

The invention is described in greater detail hereinafter relative to non-limitative embodiments and with reference to the attached drawings, wherein show.

Figure 1:
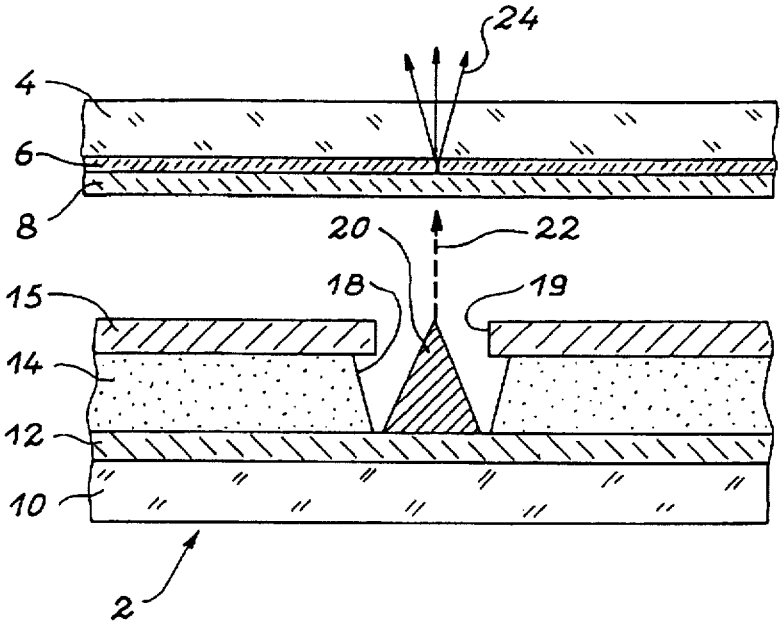
FIG. 1 PRIOR ART
FIG. 1, already described, a partial, diagrammatic sectional view of a flat screen.
Figure 2:
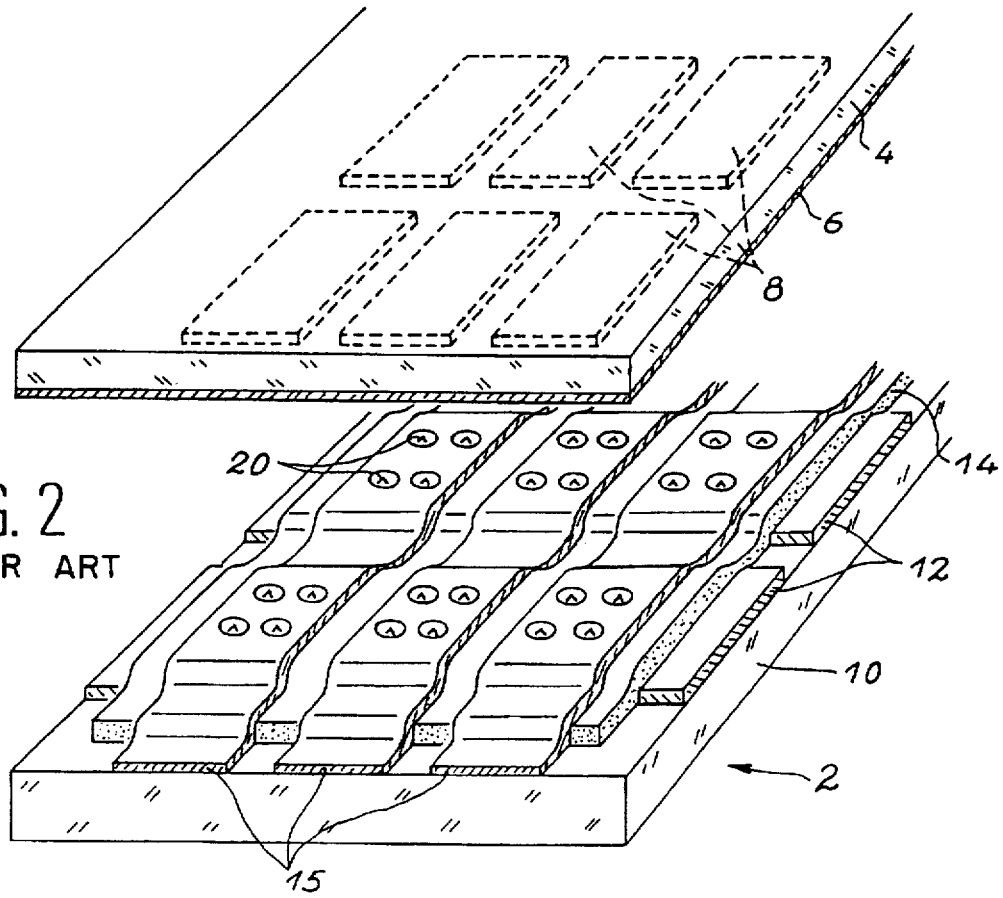
FIG. 2 PRIOR ART
FIG. 2, already described, a partial, diagrammatic, perspective view of said flat screen.
Figure 3:
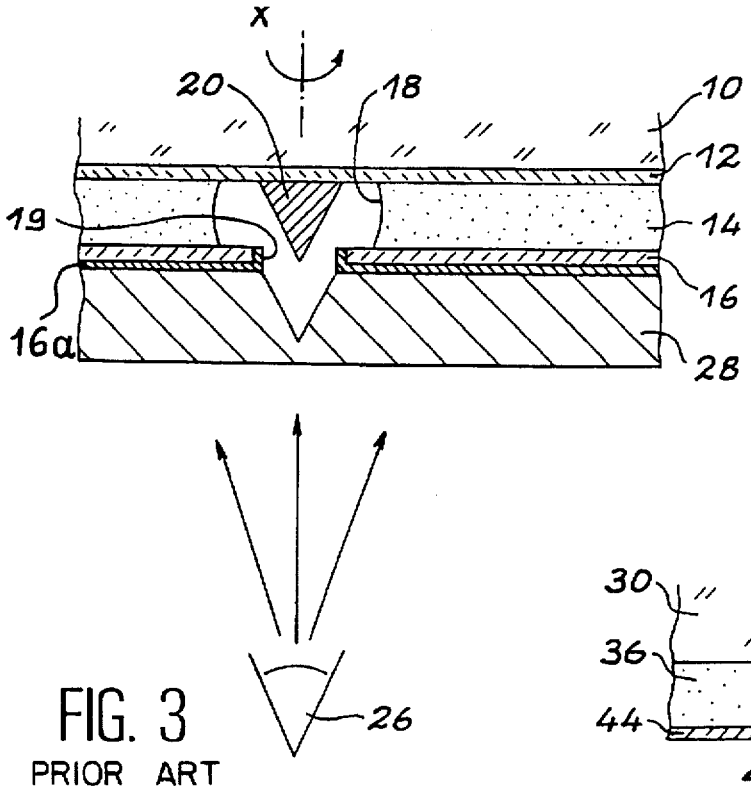
FIG. 3 PRIOR ART
FIG. 3, already described, diagrammatically a known process for the production of the microtips of a microtip electron source.
Figure 4:
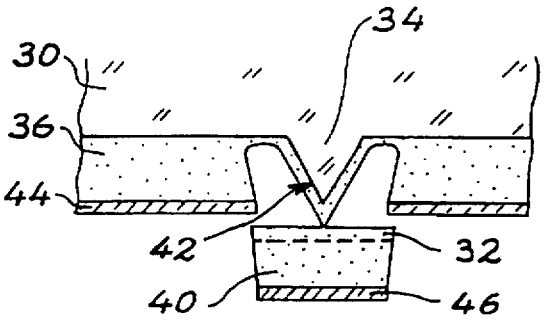
FIG. 4 PRIOR ART
FIG. 4, already described, diagrammatically another known process for the production of the microtips of a microtip electron source.
Figure 4:
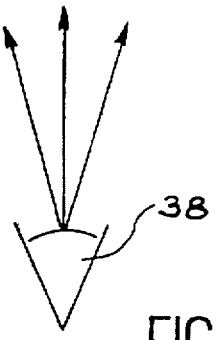
FIG. 4 PRIOR ART
Figure 5:
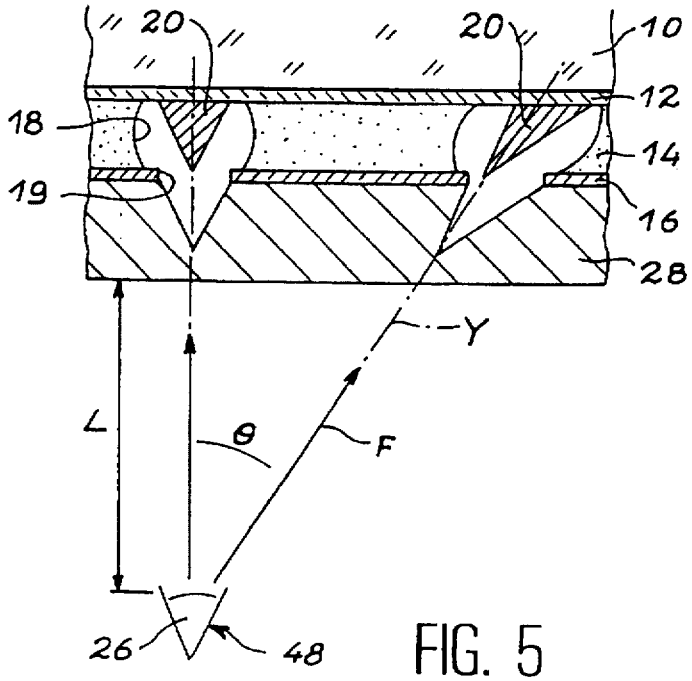
FIG. 5 PRIOR ART
FIG. 5, already described, diagrammatically the disadvantages of these known processes.
Figure 6A:
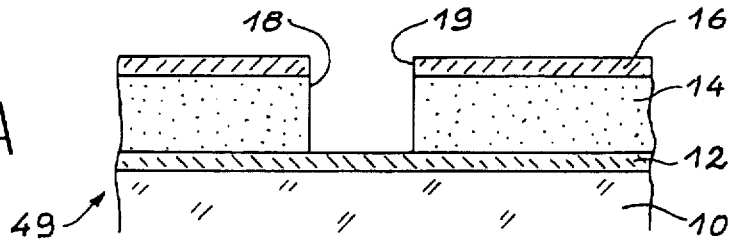
FIGS. 6A to 6E diagrammatically stages in the performance of the process according to the invention.

According to this special embodiment, the first stage is to form (FIG. 6A) a structure 49 of the type shown in FIG. 3 and which includes the electrically insulating substrate 10 on which are formed the cathode conductors 12, the electrically insulating layer 14 formed on said cathode conductors and the gate layer 16 formed on said electrically insulating layer 14 (obviously in other embodiments, the structure may only have a single cathode conductor).

It is also possible to see the substantially circular holes 18 and 19 respectively formed through the insulating layer 14 and the gate layer 16.

Processes making it possible to obtain such a structure are known from the prior art.

In exemplified manner, the substrate 10 is of glass, the cathode conductors are constituted by a double layer of chromium and copper, the layer 14 is of silica and the gate layer 16 of niobium, tantalum or aluminium.

Figure 6B:
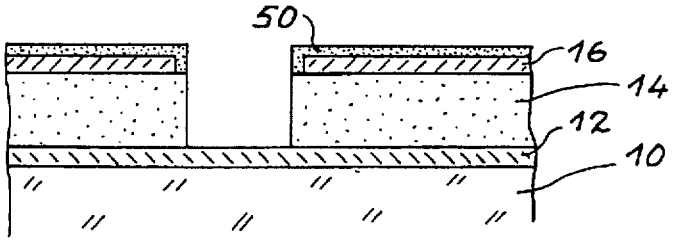

This is followed by the formation of a protective layer on the gate layer 16 (FIG. 6B). To do this, it is possible to carry out silica deposition, under grazing incidence, on the gate layer 16 in order to cover it with silica.

However, in preferred manner, there is an anodic oxidation of the gate layer 16, which leads to the formation of a layer 50 of niobium oxide, tantalum oxide or aluminium oxide in the present case, which covers the remaining part of the gate layer 16, as can be seen in FIG. 6B.

This anodic oxidation leads to a more reliable covering of the gate layer than deposition under grazing incidence referred to hereinbefore and is also simpler to implement.

Figure 6C:
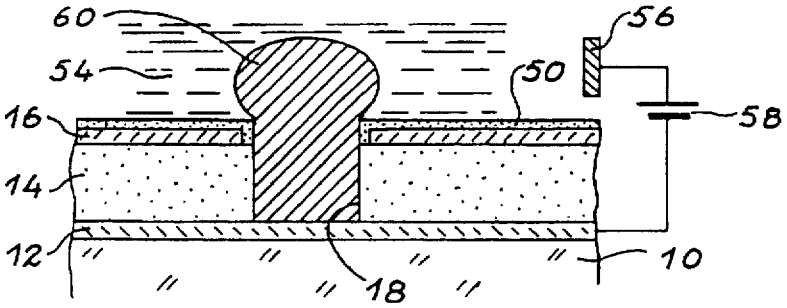

This is followed by the electrolytic deposition of a metallic material at the bottom of the holes 18 until the metallic material overflows said holes, in the manner in FIG. 6C, part of the said material then being above the layer 50.

To do this the structure 49, incorporating the protective layer 50, is placed in an appropriate electrolytic bath 54 (containing ions of the metallic material to be deposited) and in said electrolytic bath is also placed a block 56 of said metallic material.

When the metallic material is iron-nickel, it is possible to use the electrolytic bath having the following composition:

| | |
|---|---|
| $NiCl_2$, $6H_2O$ | 50 $g.l^{-1}$ |
| $NiSO_4$, $6H_2O$ | 21 $g.l^{-1}$ |
| $FeSO_4$ | 2 $g.l^{-1}$ |
| $H_3BO_3$ | 25 $g.l^{-1}$ |
| Na saccharinate | 0.8 $g.l^{-1}$ |

An appropriate voltage is then applied by means of a voltage source 58 between the cathode conductors 12 and said block 56.

When the metallic material is constituted by iron-nickel, the following conditions can be used for the electrolytic deposition:

current density : 0.5 to 2 $mA/cm^2$ voltage : 1 to 2V ambient temperature.

For electrolysis, the cathode conductors 12 serve as the cathode and the block 56 as the anode.

Figure 6D:
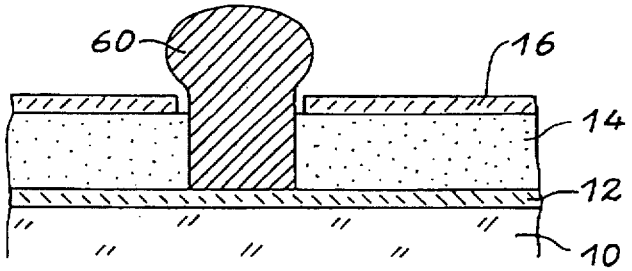

The electrically conductive elements 60 resulting from the deposition of the metallic material at the bottom of the holes 18 are in contact with the cathode conductors, but are electrically insulated from the gate layer 16 by means of a protective layer 50 covering the latter. The protective layer 50 is then eliminated by chemical etching or reactive ionic etching (FIG. 6D).

Figure 6E:
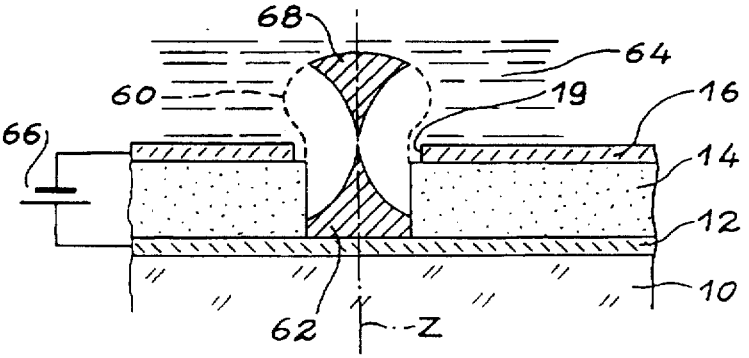

This is followed by the electrolytic etching of the electrically conductive elements 60, so as to form microtips 62 therefrom (FIG. 6E).

In order to do this, the structure, from which the protective layer 50 has been eliminated, is placed in an appropriate electrolytic bath 64 (e.g. containing 10% of 37% HCl and 90% $H_2O$ for dissolving the iron-nickel) and, by means of an appropriate voltage source 66, a voltage is produced (e.g. 1 to 2 V for dissolving the iron-nickel) between the cathode conductors 12 which, in this case, serve as the anode, and the gate layer 16 serving as the cathode.

Preferably the electrolyte is regenerated by stirring and/or circulation, so as to avoid a concentration of ions around the material of the elements 60.

During electrolysis, the material of the elements 60 is eliminated in a substantially symmetrical manner around the axis Z of the holes 18 and the metallic ions produced by the chemical etching of the material of the elements 60 are in part eliminated due to the regeneration of the electrolyte and in part redeposited on the gate layer.

As a function of the material of the elements 60 and the electrolyte regeneration rate, the redeposited fraction of the ions may be larger or smaller and can be controlled.

The wear undergone by the conductive elements 60 due to electrolysis leads to obtaining:

pointed elements substantially flush with the surface of the gate layer 16 and forming microtips 62 and portions 68 which are detached from said microtips and remain in the electrolytic bath, as can be seen in FIG. 6E.

Preferably, said microtip formation stage takes place with the glass substrate above and the electrolytic bath below, so as to enable the portions 68 to drop into the electrolytic bath.

The formation of the microtip electron source is completed in known manner by forming, from the gate layer 16, not shown, parallel gates forming an angle with the cathode conductor (however if there is only one cathode conductor, the gate layer will be kept as it is).

The interest of the process according to the present invention is that it makes it possible to produce self-aligned microtips on the holes of the gate layer 16 using a non-directional method and in an isotropic liquid medium (electrolytic bath 64).

Thus, the process according to the invention is independent of the surface of the structure where it is wished to form the microtips.

We claim :

1. Process for the production of a microtip electron source, in which:

a structure (49) is produced which comprises an electrically insulating substrate (10), at least one cathode conductor (12) on said substrate, an electrically insulating layer (14) covering each cathode conductor, an electrically conductive gate layer (16) covering said electrically insulating layer, holes (18, 19) being formed through said gate layer and the electrically insulating layer, at each cathode conductor and in each hole is formed a microtip (62), which is made from an electron emitting metallic material and which rests on the cathode conductor corresponding to said hole, said process being characterized in that the formation of the microtips involves the following steps:

forming an electrically insulating protective layer (50) on the gate layer (16);

a step of chemically depositing the electron emitting metallic material at the bottom of the holes until said metallic material overflows the holes;

eliminating the protective layer (50); and a step of electrolytically etching the deposited metallic material, in order to obtain the microtips (62) from said metallic material.

2. Process according to claim 1, characterized in that the step of chemically depositing the electron emitting metallic material is performed using an electrolytic deposit.

3. Process according to claim 1, characterized in that the gate layer (16) is used as the cathode for the electrolytic etching of the metallic material.

4. Process according to claim 1, characterized in that the protective layer (50) is formed by depositing, under grazing incidence, a layer of electrically insulating material on the gate layer (16).

5. Process according to claim 1, characterized in that the protective layer is formed by anodic oxidation of the gate layer (16).

6. Process according to claim 1, characterized in that the gate layer (16) is made from a material chosen from within the group including niobium, tantalum and aluminium.

7. Process according to claim 1, characterized in that the metallic material is chosen from within the group including iron, nickel, chromium, Fe—Ni, gold, silver and copper.

8. Process according to claim 1, characterized in that the protective layer (50) is eliminated by chemical etching.

9. Process according to claim 1, characterized in that the protective layer (50) is eliminated by reactive ionic etching.

* * * * *